US009883750B2

(12) United States Patent
Yi

(10) Patent No.: US 9,883,750 B2
(45) Date of Patent: Feb. 6, 2018

(54) FRAME HEIGHT ADJUSTING MECHANISM AND FRAME THEREWITH

(71) Applicant: Ze-Hua Yi, Guangdong (CN)

(72) Inventor: Ze-Hua Yi, Guangdong (CN)

(73) Assignee: Wonderland Switzerland AG, Steinhausen (CH)

( * ) Notice: Subject to any disclaimer, the term of this patent is extended or adjusted under 35 U.S.C. 154(b) by 9 days.

(21) Appl. No.: 14/882,478

(22) Filed: Oct. 14, 2015

(65) Prior Publication Data

US 2016/0106226 A1 Apr. 21, 2016

(30) Foreign Application Priority Data

Oct. 15, 2014 (CN) ..... 2014 1 0546546

(51) Int. Cl.

| | |
|---|---|
| ***A47C 31/00*** | (2006.01) |
| ***A47D 9/00*** | (2006.01) |
| *A61G 13/06* | (2006.01) |
| *A61G 7/012* | (2006.01) |
| *A61G 7/018* | (2006.01) |
| *A61G 13/02* | (2006.01) |
| *A47C 19/04* | (2006.01) |

(52) U.S. Cl.

CPC ..... *A47D 9/00* (2013.01); *A47C 19/045* (2013.01); *A61G 7/012* (2013.01); *A61G 7/018* (2013.01); *A61G 13/02* (2013.01); *A61G 13/06* (2013.01)

(58) Field of Classification Search

CPC .... A47C 19/04; A47C 19/045; A61G 3/0866; A61G 5/105; A61G 7/012; A61G 7/018; A47D 9/00; Y10T 403/7077; Y10T 403/7079; Y10T 403/32467; F16B 7/10

See application file for complete search history.

(56) References Cited

U.S. PATENT DOCUMENTS

| | | | | | |
|---|---|---|---|---|---|
| 2,381,759 | A | * | 8/1945 | Lanese | A47D 9/00 5/93.2 |
| 2,545,289 | A | * | 3/1951 | Lang | A61G 7/012 5/11 |
| 2,569,555 | A | * | 10/1951 | Chanslor | A47D 9/00 108/190 |

(Continued)

FOREIGN PATENT DOCUMENTS

| | | | | |
|---|---|---|---|---|
| EP | 2614754 | * | 1/2013 | A47D 7/00 |
| EP | 2 614 754 A1 | | 7/2013 | |

*Primary Examiner* — David E Sosnowski
*Assistant Examiner* — Morgan J McClure
(74) *Attorney, Agent, or Firm* — Winston Hsu

(57) ABSTRACT

A frame height adjusting mechanism is adapted for a frame including an inner pipe and an outer pipe sheathing on the inner pipe. A fixing hole is formed on one of the inner pipe and the outer pipe. A plurality of positioning holes is formed on the other one of the inner pipe and the outer pipe. The frame height adjusting mechanism includes a driving member which is slidably disposed on the inner pipe or the outer pipe where the fixing hole is formed and includes at least one first inclined surface, and at least one engaging member which is slidably disposed on the driving member and passing through the fixing hole to insert into one of the plurality of positioning holes. The at least one first inclined surface pushes the at least one engaging member to disengage from the corresponded positioning hole when the driving member slides upwardly.

17 Claims, 16 Drawing Sheets

(56) References Cited

U.S. PATENT DOCUMENTS 2,592,166 A * 4/1952 McLean ..... A61G 7/012 280/43.21
3,039,118 A * 6/1962 Hutt ..... A61G 7/012 5/11
3,281,872 A * 11/1966 Dewey ..... A61G 7/012 5/611
3,789,439 A * 2/1974 Berg ..... A47D 13/063 5/93.2
4,021,867 A * 5/1977 Maxwell, Jr. ..... A47D 9/02 297/270.2
4,227,269 A * 10/1980 Johnston ..... A61G 7/002 5/611
4,674,776 A * 6/1987 James ..... E05B 13/004 292/150
4,752,977 A * 6/1988 Smith ..... A47D 7/02 292/336.3
4,813,808 A * 3/1989 Gehrke ..... F16B 21/16 24/625
5,199,122 A * 4/1993 Styblo ..... A47C 19/045 248/188.2
5,779,386 A * 7/1998 Eichhorn ..... A47D 13/105 403/109.3
5,803,643 A * 9/1998 Patelli ..... F16B 7/1463 15/144.4
5,819,340 A * 10/1998 Kelly ..... A47D 9/00 5/93.1
5,957,436 A * 9/1999 Ristau ..... A47D 13/063 256/25
6,301,732 B1 * 10/2001 Smith ..... A47C 19/024 5/660
6,308,359 B2 * 10/2001 Fritsch ..... A61C 17/22 15/22.1
6,409,412 B1 * 6/2002 Huang ..... F16B 2/246 248/188.5
6,505,365 B1 * 1/2003 Hanson ..... A61G 7/005 5/510
6,507,964 B1 * 1/2003 Lewandowski ..... A61G 7/012 5/600
6,779,210 B1 * 8/2004 Kelly ..... A47C 19/045 5/11
7,025,522 B2 * 4/2006 Sicz ..... B62J 1/08 248/188.5
7,029,078 B1 * 4/2006 Fromme ..... A47B 47/02 312/216
7,168,373 B1 * 1/2007 Hock ..... A47B 91/02 108/147.11
7,222,892 B2 * 5/2007 Guidetti ..... F16B 2/246 292/305
8,388,254 B2 * 3/2013 Huang ..... F16B 7/105 403/109.1
8,756,728 B2 * 6/2014 Bergkvist ..... A47D 9/02 5/101
9,248,072 B2 * 2/2016 Wu ..... A61H 3/04
9,365,145 B2 * 6/2016 Millasseau ..... B60N 3/063
9,504,299 B2 * 11/2016 Ma ..... A45B 25/02
2004/0078894 A1 * 4/2004 Snyder ..... A61G 7/012 5/11
2004/0148698 A1 * 8/2004 Snyder ..... A47C 19/045 5/11
2006/0090262 A1 * 5/2006 Hennings ..... A47C 19/04 5/658
2009/0224591 A1 * 9/2009 Langhorn ..... A47D 11/02 297/423.39
2010/0162482 A1 * 7/2010 Cohen ..... A47C 19/045 5/11
2012/0017369 A1 * 1/2012 Li ..... A47D 9/00 5/93.1
2016/0213538 A1 * 7/2016 Salus ..... A61G 7/0507
2016/0286979 A1 * 10/2016 Sclare ..... A47D 9/00

* cited by examiner

FRAME HEIGHT ADJUSTING MECHANISM AND FRAME THEREWITH

BACKGROUND OF THE INVENTION

1. Field of the Invention

The present invention relates to an infant carrier, and more particularly, to a frame height adjusting mechanism and a frame therewith.

2. Description of the Prior Art

A conventional baby bed usually includes a frame and a cradle fixed above the frame. However, it has the disadvantages that the conventional body bed has only one mode of use when it is in use, and a height of the cradle cannot be adjusted after a baby lies on the cradle. Therefore, it is not convenient for parents to look after their baby. There is another conventional baby bed having a detachable structure which includes a frame and a cradle detachably installed on the frame, i.e., the cradle can be installed on the frame or detached from the frame, such that the cradle can be placed on the ground or other locations. Since such conventional baby bed has two modes of use, it is more flexible than the conventional one with only one using mode. However, a height of the cradle of such conventional baby cot still cannot be adjusted according to heights of parents or actual requirement.

Therefore, there is a need to design a frame height adjusting mechanism capable of adjusting a height of a frame, so as to adjust a height of a cradle easily.

SUMMARY OF THE INVENTION

The present invention aims at providing a frame height adjusting mechanism and a frame therewith to solve the above-mentioned drawbacks.

According to the claimed invention, a frame height adjusting mechanism is adapted for a frame including an inner pipe and an outer pipe sheathing on the inner pipe. A fixing hole is formed on one of the inner pipe and the outer pipe. A plurality of positioning holes is formed on the other one of the inner pipe and the outer pipe along a vertical direction, and the frame height adjusting mechanism includes a driving member and at least one engaging member. The driving member is slidably disposed on the inner pipe or the outer pipe where the fixing hole is formed. The driving member includes at least one first inclined surface. The at least one engaging member is slidably disposed on the driving member and passing through the fixing hole to insert into one of the plurality of positioning holes. The at least one first inclined surface pushes the at least one engaging member to disengage from the corresponded positioning hole when the driving member slides upwardly.

Preferably, the frame further includes a horizontal pipe. The outer pipe is fixed on a lower end of the horizontal pipe. The fixing hole is formed on a front side of a lower end of the outer pipe. The plurality of positioning holes is formed on a side of the inner pipe adjacent to the fixing hole. The at least one engaging member and the at least one first inclined surface are disposed on a lower end of the driving member. An upper end of the driving member passes through the horizontal pipe upwardly and is movable relative to the horizontal pipe along the vertical direction. The frame height adjusting mechanism further includes a linking member slidably disposed on the horizontal pipe along a longitudinal direction of the horizontal pipe. The linking member includes at least one second inclined surface driven to push the driving member by the linking member.

Specifically, an extending direction of the at least one second inclined surface and a sliding direction of the linking member are located in a same plane, and the frame height adjusting mechanism further includes at least one first contacting portion disposed on the upper end of the driving member and abutting against an lower end of the at least one second inclined surface.

More specifically, the driving member further includes a rectangular portion, and the at least one first contacting portion is a column protruding from a side of the rectangular portion.

Furthermore, an avoiding slot is formed on the linking member and extends along the sliding direction of the linking member. The driving member passes through the linking member. The rectangular portion is slidably received in the avoiding slot. The linking member includes two second inclined surfaces disposed on two sides of the avoiding slot, and the frame height adjusting mechanism includes two first contacting portions respectively protruding from two sides of the rectangular portion.

Furthermore, a guiding slot is formed on the outer pipe along the vertical direction, and the rectangular portion is slidably received in the guiding slot.

Specifically, a sliding slot is sunk from a top surface of the horizontal pipe, and the linking member is slidably received in the sliding slot.

More specifically, the frame further includes a cover installed on the horizontal pipe and covering the linking member.

Furthermore, the frame height adjusting mechanism further includes a first resilient member disposed between the cover and the linking member, and the first resilient member provides a first resilient force for pushing the driving member downwardly.

Furthermore, the frame height adjusting mechanism further includes a stopping portion and an abutting portion. The stopping portion upwardly protrudes from an end of the linking member near a lower end of the at least one second inclined surface. The abutting portion downwardly protrudes from the cover and abuts against a side of the stopping portion toward the at least one second inclined surface.

Furthermore, a circular hole is formed on the cover for allowing the driving member to pass through upwardly, and the circular hole penetrates the abutting portion.

Specifically, the at least one first inclined surface obliquely extends away from a rear side of the outer pipe from top to bottom, the at least one engaging member includes a second contacting portion, the second contacting portion abuts against an upper end of the at least one first inclined surface when the at least one engaging member is inserted into one of the plurality of positioning holes.

More specifically, a recess area is formed on a front side of the outer pipe. The fixing hole is formed on a bottom wall of the recess area. The driving member is located in the recess area. A long hole is formed on the lower end of the driving member and corresponded to the fixing hole. The long hole extends along the vertical direction. The at least one first inclined surface located at an outer periphery of the long hole protrudes from a side of the driving member away from the rear side of the outer pipe. The at least one engaging member is a pin of a rotating structure, and the second contacting portion protrudes from an outer periphery of the at least one engaging member.

Furthermore, a U-shaped portion protrudes from the side of the driving member away from the rear side of the outer pipe and encloses a lower portion of the long hole, and the at least one first inclined surface is formed on an upper end of each of two side walls of the U-shaped portion.

Furthermore, the frame further includes a lower plug detachably inserted into the lower end of the outer pipe. The lower plug includes a sliding portion slidably received in the recess area, and a through hole is formed on the sliding portion and corresponded to the fixing hole.

Furthermore, the frame height adjusting mechanism further includes a second resilient member disposed between the lower plug and the at least one engaging member. The second resilient member provides a second resilient force for inserting the at least one engaging member into one of the plurality of positioning holes.

Specifically, the frame height adjusting mechanism further includes an operating member and a connecting wire. The operating member is slidably disposed on the frame. An end of the connecting wire is fixed on the operating member, and the other end of the connecting wire extends along the horizontal pipe and is fixed on the linking member.

Preferably, the fixing hole is formed on the inner pipe. The plurality of positioning holes is formed on the outer pipe. The at least one engaging member includes a locking member and a sliding pin protruding from a side of the locking member. A sliding slot is formed on the driving member obliquely. The sliding pin is slidably received in the sliding slot. The sliding slot is gradually away from the fixing hole corresponded to the at least one engaging member from top to bottom. The at least one first inclined surface is formed on a side of the sliding slot near the fixing hole corresponded to the at least one engaging member, and the sliding pin is located at an upper end of the sliding slot when the locking member is inserted into the fixing hole.

Specifically, the sliding slot penetrates the driving member. The hollow chamber is formed in the driving member and communicates with the sliding slot. The locking member is slidably received in the hollow chamber, and the sliding pin protrudes from two sides of the locking member.

Specifically, the fixing hole is formed on each of a left side and a right side of the inner pipe. The plurality of positioning holes is formed on each of a left side and a right side of the outer pipe. Two sliding slots are formed on the driving member symmetrically, and the frame height adjusting mechanism includes two engaging members disposed in the two sliding slots respectively.

Specifically, the frame further includes a lower plug detachably installed on a lower end of the inner pipe. The lower plug is inserted into the inner pipe upwardly. The driving member is slidably received in the lower plug, and an inner bottom surface of the lower plug is under the driving member.

Specifically, a long slot is formed on the driving member and extends along the vertical direction. The frame height adjusting mechanism further includes a lower rivet, an upper rivet, and a third resilient member. A lower end of the long slot is enlarged to receive the lower rivet. A positioning through hole penetrates the inner pipe and is corresponded to the long slot. The upper rivet passes through the positioning through hole and is slidably disposed in the long slot, and the third resilient member is disposed between the upper rivet and the lower rivet and provides a third resilient force for pushing the driving member to slide downwardly relative to the inner pipe.

Specifically, the frame height adjusting mechanism further includes an operating member and a connecting wire. The operating member is slidably disposed on the frame. An end of the connecting wire is fixed on the operating member, and the other end of the connecting wire extends along the horizontal pipe and is fixed on the driving member.

According to the claimed invention, a frame includes two bottom feet, two lower stands, two upper stands, a bottom pipe, a horizontal pipe, an inner pipe, an outer pipe, a frame height adjusting mechanism. The two bottom feet are disposed oppositely. The two lower stands are vertically fixed on the two bottom feet respectively. The two upper stands sheathes on the two lower stands respectively. The bottom pipe is disposed between the two bottom feet. The horizontal pipe fixed between the two upper stands. The outer pipe slidably sheathes on the inner pipe. A fixing hole is formed on one of the inner pipe and the outer pipe. A plurality of positioning holes is formed on the other one of the inner pipe and the outer pipe along a vertical direction. The inner pipe or the outer pipe where the fixing hole is formed is fixed on a lower end of the horizontal pipe, and the inner pipe or the outer pipe where the fixing hole is not formed is fixed on the bottom pipe. The frame height adjusting mechanism includes a driving member and at least one engaging member. The driving member is slidably disposed on the inner pipe or the outer pipe where the fixing hole is formed. The driving member includes at least one first inclined surface. The at least one engaging member is slidably disposed on the driving member and passing through the fixing hole to insert into one of the plurality of positioning holes. The at least one first inclined surface pushes the at least one engaging member to disengage from the corresponded positioning hole when the driving member slides upwardly.

Preferably, the frame further includes a supporting pipe installed on the horizontal pipe.

Specifically, the supporting pipe is rectangular. The frame further includes two installing seats disposed on two ends of the horizontal pipe. An engaging slot is formed on each of the two installing seats, and two side pipes of the supporting pipe detachably respectively engage with the two engaging slots.

Preferably, the frame further includes a handle fixed between the two upper stands and disposed on tops of the two upper stands.

In summary, the present invention utilizes the driving member for driving the at least one engaging member to engage with or disengage from one of the plurality of positioning holes. When the driving member drives the at least one engaging member to disengage from the corresponded positioning hole by sliding upwardly, the outer pipe can slide relative to the inner pipe vertically. After the outer pipe is adjusted to a desired height relative to the inner pipe, the driving member recovers downwardly and drives the at least one engaging member to engage with another positioning hole, so as to lock the outer pipe and the inner pipe. In a practical application, one of the inner pipe and the outer pipe is fixed on one of a lower part and an upper part of the frame, and the other one of the inner pipe and the outer pipe is fixed on the other one of a lower part and an upper part of the frame. Accordingly, an overall height of the frame can be adjusted by sliding movement of the outer pipe relative to the inner pipe. Therefore, a height of a cradle supported by the frame can be adjusted according to actual requirement.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
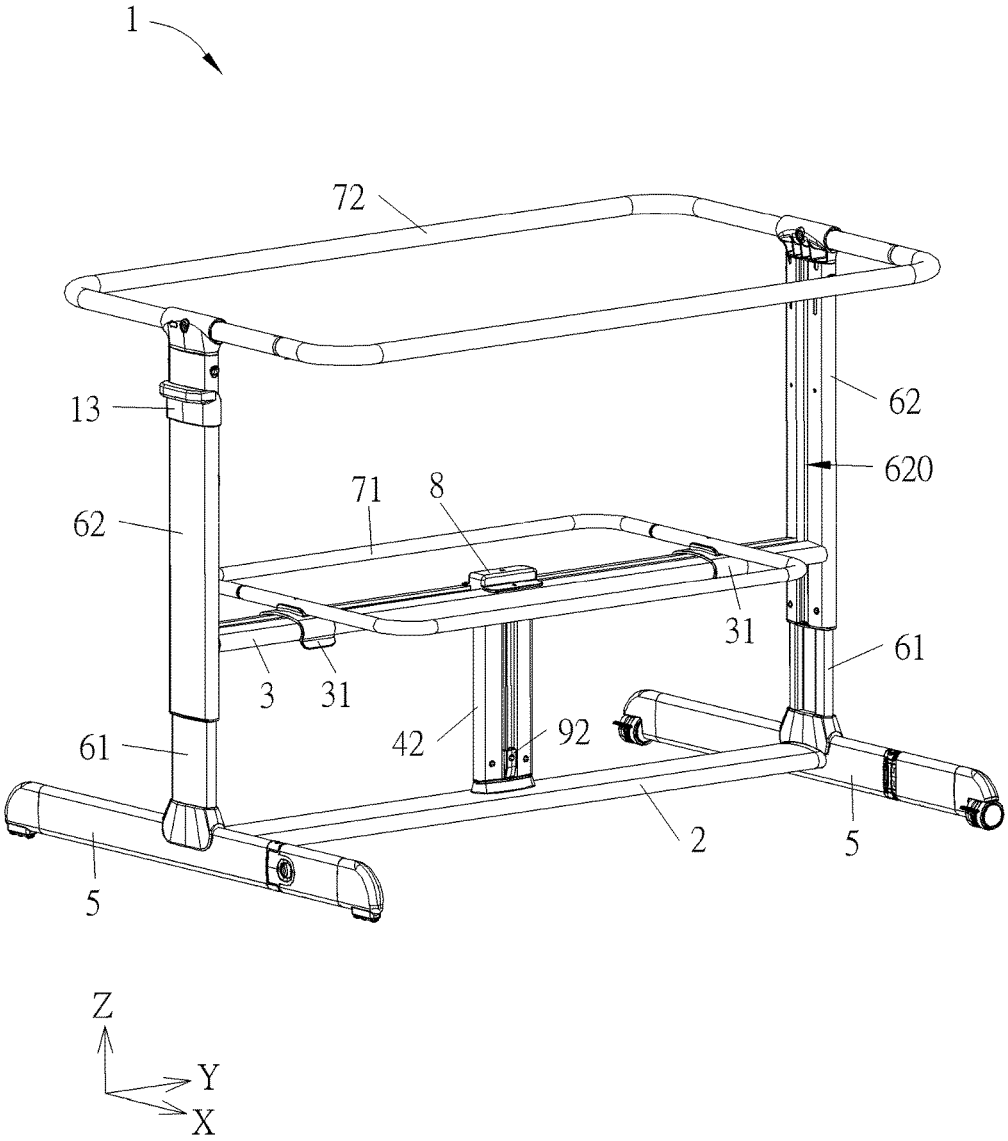
FIG. 1 is a schematic diagram of a frame according to a first embodiment of the present invention.
Figure 2:
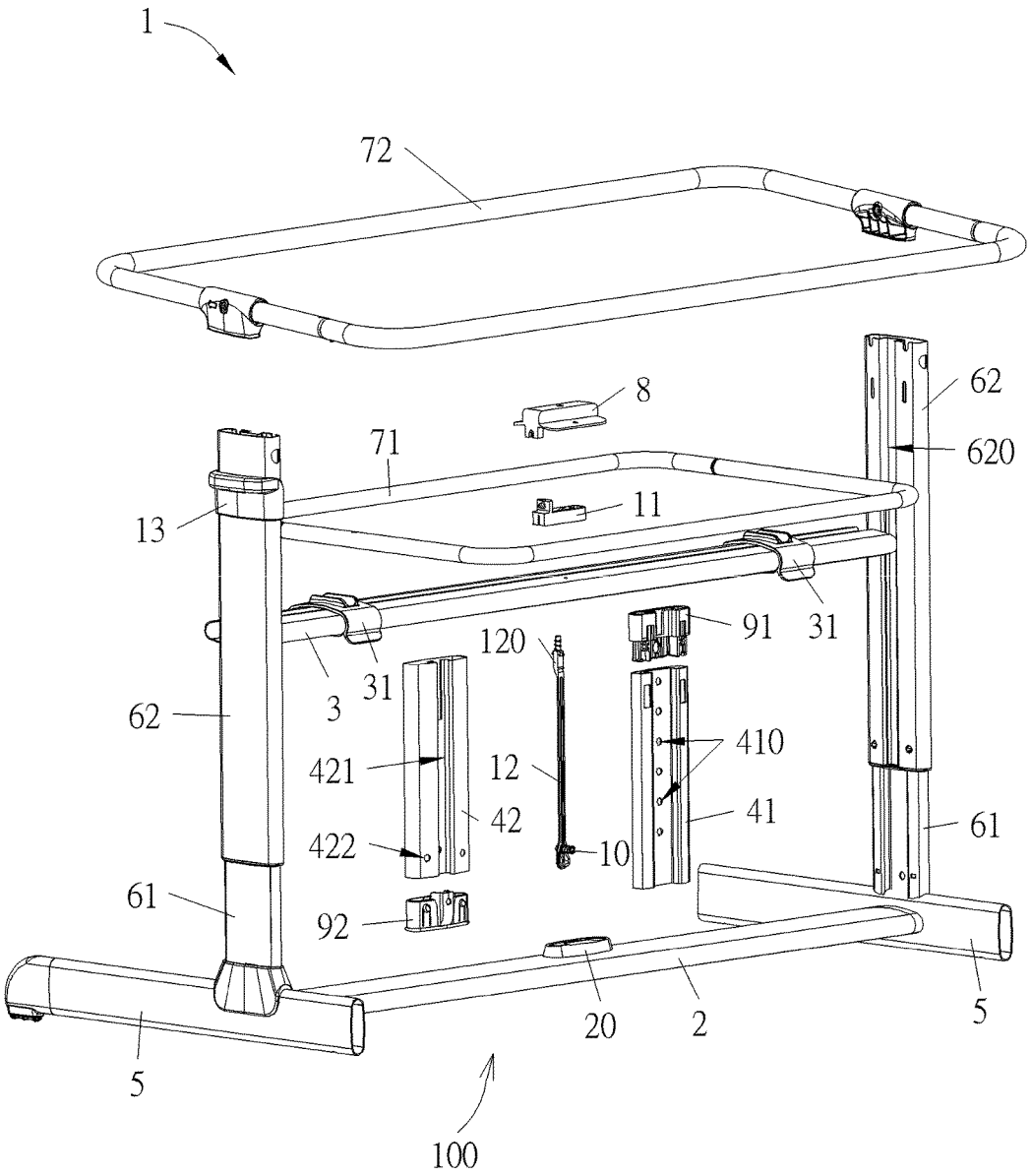
FIG. 2 is a partial exploded diagram of the frame according to the first embodiment of the present invention.

Please refer to FIG. 1 and FIG. 2. FIG. 1 is a schematic diagram of a frame 1 according to a first embodiment of the present invention. FIG. 2 is a partial exploded diagram of the frame 1 according to the first embodiment of the present invention. The frame 1 include a bottom pipe 2, a horizontal pipe 3, an inner pipe 41, an outer pipe 42, two bottom feet 5, two lower stands 61, two upper stands 62, and a frame height adjusting mechanism 100. The two bottom feet 5 are disposed oppositely. The bottom pipe 2 is fixed between the two bottom feet 5. The two lower stands 61 are vertically fixed on the two bottom feet 5 respectively. The two upper stands 62 slidably sheathe on the two lower stands 61 respectively. The horizontal pipe 3 is fixed between the two upper stands 62. The inner pipe 41 is fixed on the bottom pipe 2. The outer pipe 42 is installed on a lower end of the horizontal pipe 3 and slidably sheathes on the inner pipe 41.

Figure 3:
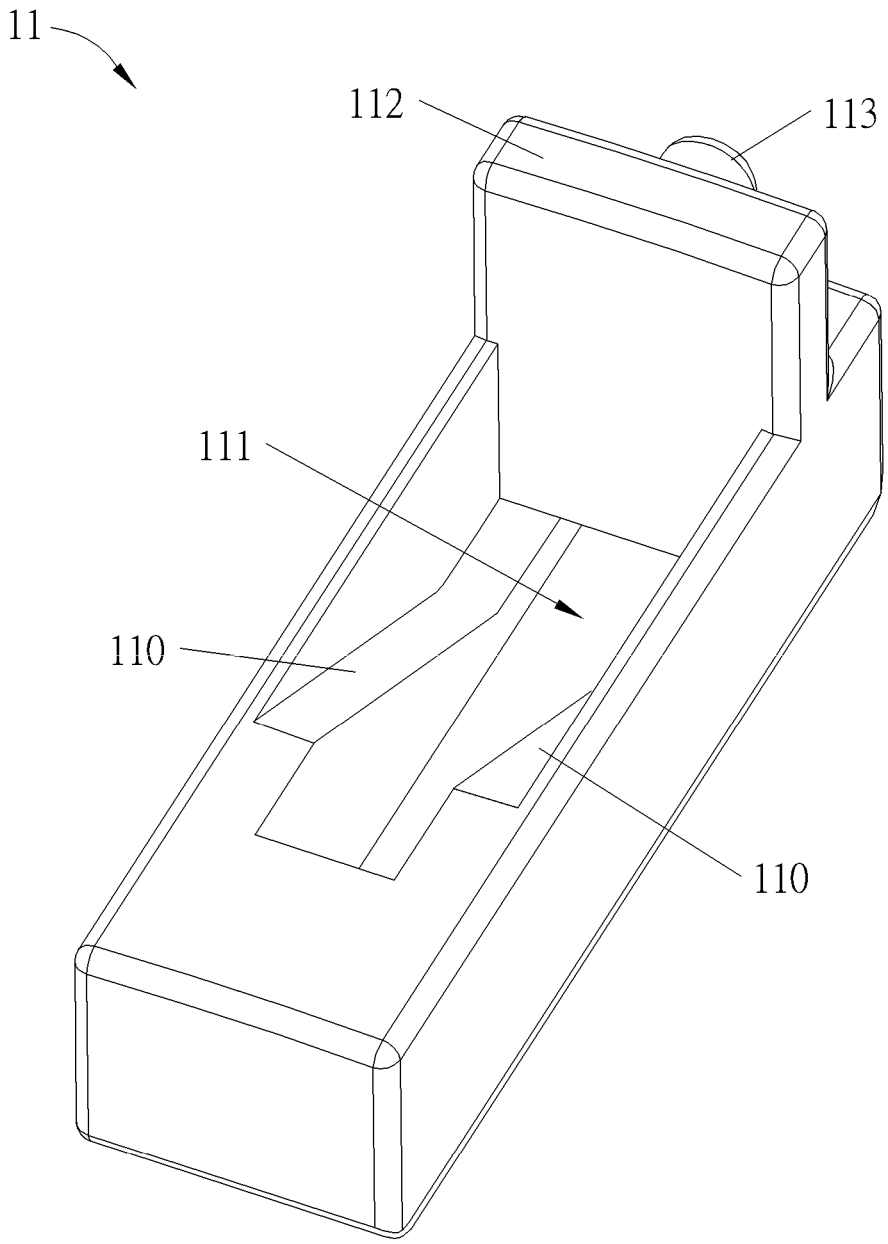
FIG. 3 is a schematic diagram of a linking member of a frame height adjusting mechanism according to the first embodiment of the present invention.
Figure 4:
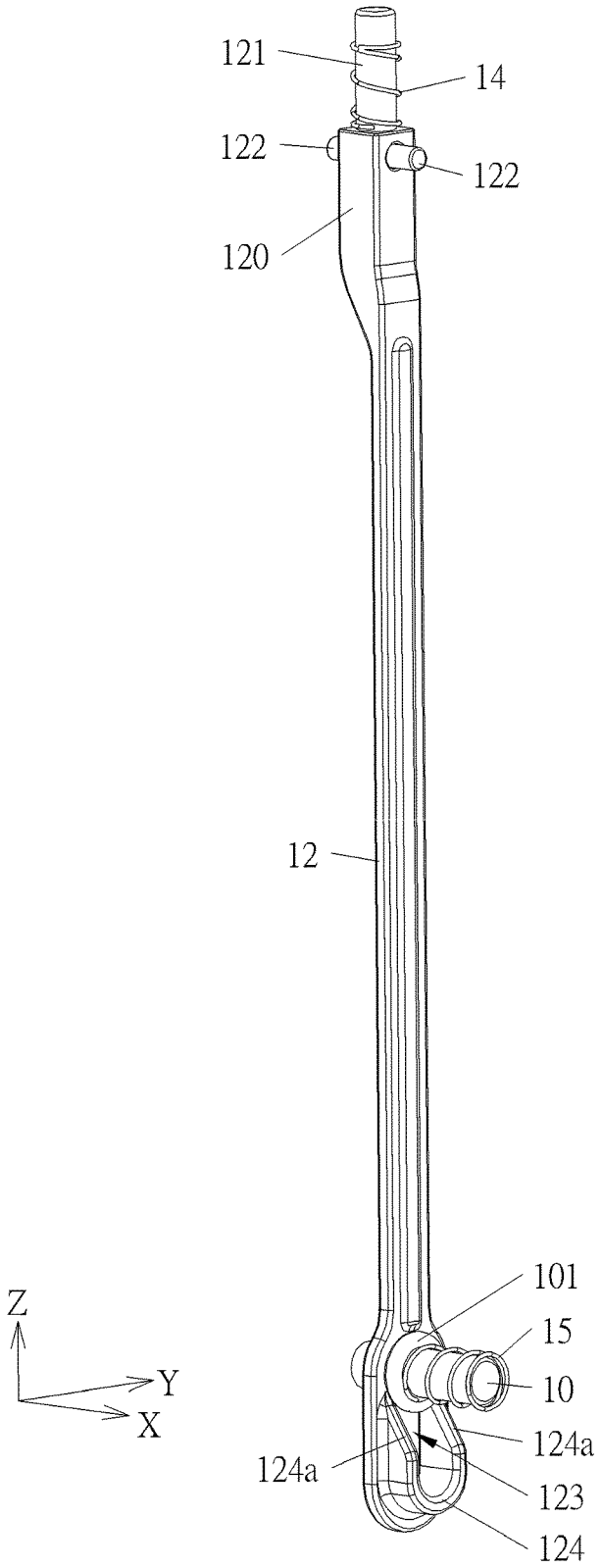
FIG. 4 is a schematic diagram of a driving member, a first resilient member, a second resilient member and an engaging member of the frame height adjusting mechanism according to the first embodiment of the present invention.
Figure 5:
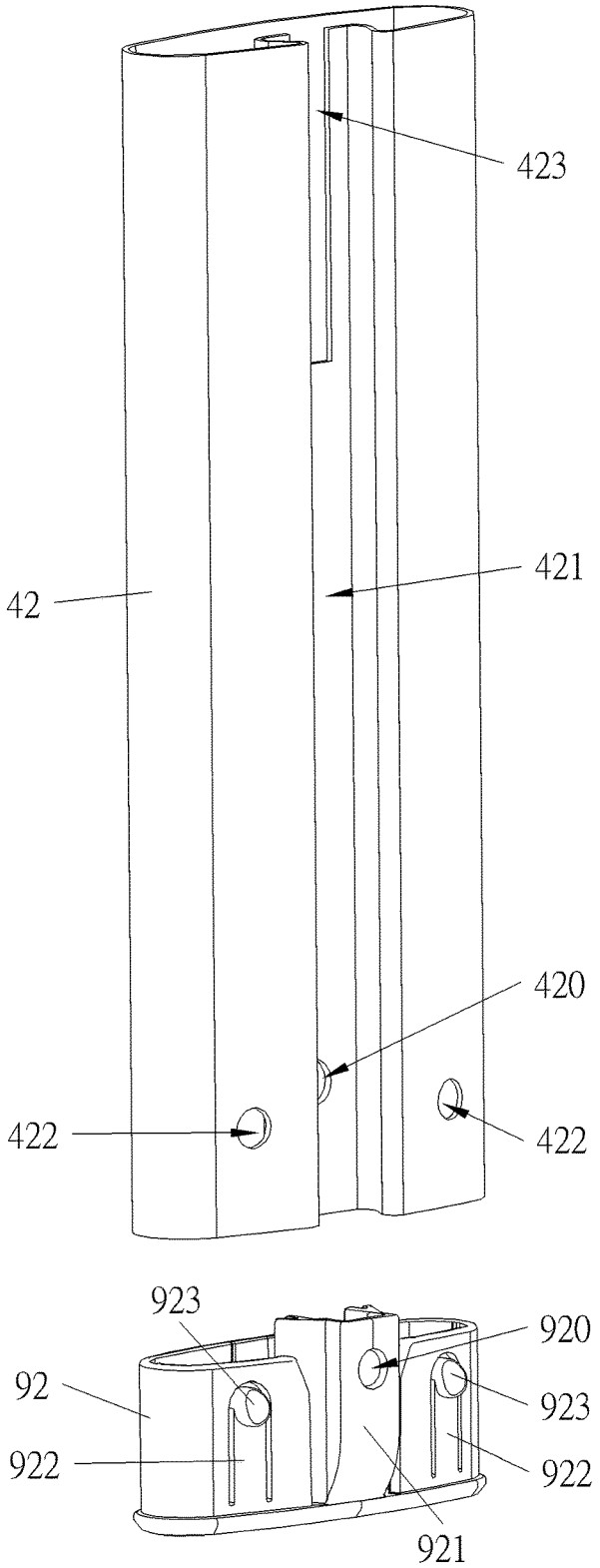
FIG. 5 is a schematic diagram of an outer pipe and a lower plug according to the first embodiment of the present invention.

Please refer to FIG. 3 to FIG. 5. FIG. 3 is a schematic diagram of a linking member 11 of the frame height adjusting mechanism 100 according to the first embodiment of the present invention. FIG. 4 is a schematic diagram of a driving member 12, a first resilient member 14, a second resilient member 15 and an engaging member 10 of the frame height adjusting mechanism 100 according to the first embodiment of the present invention. FIG. 5 is a schematic diagram of the outer pipe 42 and a lower plug 92 according to the first embodiment of the present invention. The frame height adjusting mechanism 100 includes the engaging member 10, the linking member 11, and the driving member 12. The linking member 11 is slidably disposed on the horizontal pipe 3 along a longitudinal direction of the horizontal pipe 3. The driving member 12 passes through the horizontal pipe 3 along a vertical direction, i.e., a Z-axis, and the driving member 12 is movable relative to the horizontal pipe 3 along the vertical direction. A second inclined surface 110 is obliquely formed on the linking member 11 from top to bottom. The second inclined surface 110 pushes the driving member 12 upwardly by sliding movement of the linking member 11. A fixing hole 420 is formed on a front side of a lower end of the outer pipe 42. A plurality of positioning holes 410 is formed on a side of the inner pipe 41 adjacent to the fixing hole 420 and along the vertical direction. The engaging member 10 is disposed on a lower end of the driving member 12 and passes through the fixing hole 420 to insert into one of the plurality of positioning holes 410. A first inclined surface **124*a* is obliquely formed on the lower end of the driving member 12 from top to bottom. The first inclined surface 124*a* pushes the engaging member 10 to disengage from the corresponded positioning hole 410 by upward displacement of driving member 12**.

In a practical application, a carrier, such as a cradle, can be installed on the horizontal pipe 3 or the two upper stands 62. The driving member 12 is driven to move upwardly by operating the linking member 11. When the driving member 12 moves upwardly, the first inclined surface **124*a* on the driving member 12 drives the engaging member 10 to move away from a rear side of the outer pipe 42 and disengage from the corresponded positioning hole 410, such that the horizontal pipe 3 and the two upper stands 62** can slide up and down, which achieves a purpose of adjusting a height of the carrier.

Specifically, the frame height adjusting mechanism 100 further includes an operating member 13, a connecting wire 131, the first resilient member 14, and the second resilient member 15. The frame 1 further includes a supporting pipe 71, a handle 72, a cover 8, an upper plug 91 and the lower plug 92.

As shown in FIG. 3, the linking member 11 is a substantially cuboid structure. An avoiding slot 111 is formed on a middle portion of the linking member 11 and penetrates the linking member 11 along the vertical direction. The avoiding slot 111 extends along a longitudinal direction of the linking member 11, i.e., a sliding direction of the linking member 11 relative to the horizontal pipe 3. Two second inclined surfaces 110 are formed on two sides of the avoiding slot 111, such that each of two side walls of the avoiding slot 111 is formed in a wedge shape. An extending direction of each second surface 110 and a sliding direction of the linking member 11 are located in a same plane, i.e., a Y-Z plane shown in FIG. 1. A stopping portion 112 upwardly protrudes from an end of the linking member 11 near a side of two lower ends of the two second inclined surfaces 110. Furthermore, a protruding column 113 horizontally protrudes from a side of the stopping portion 112 away from the two second inclined surfaces 110. It should be noticed that the present invention utilizes two second inclined surfaces 110 for stably driving the driving member 12 in this embodiment. However, in another embodiment, there also can be only one second inclined surface 110 formed on the linking member 11 to drive the driving member 12.

As shown in FIG. 4, the driving member 12 is a substantially rod-shaped structure. A rectangular portion 120 is formed on an upper end of the driving member 12 and has a rectangular cross section. A guiding column 121 is fixed on a top surface of the rectangular portion 120. The first resilient member 14 is a spring which sheathes on the guiding column 121. Two first contacting portions 122 protrude from a front side and a rear side of the rectangular portion 120 respectively and cooperate with the two second inclined surfaces 110 respectively. Specifically, the two first contacting portions 122 are columns protruding from the front side and the rear side of the rectangular portion 120. In this embodiment, in order to simplify assembly, the rectangular portion 120 can be drilled for allowing a pin to pass through the rectangular portion 120, so as to form the two first contacting portions 122. A thickness of a middle portion of the driving member 12 along an up and down direction, i.e., an X axis, becomes thinner than a thickness of the rectangular portion 120 along the front and back direction. The middle portion of the driving member 12 is connected to a rear connecting area of the rectangular portion 120 via an inclined surface. A long hole 123 is formed on the lower end of the driving member 12 and penetrates the driving member 12 along the front and back direction. A U-shaped portion 124 with an upward opening protrudes from a front side of the lower end of the driving member 12. The U-shaped portion 124 is formed along an outer periphery of the long hole 123 and encloses a lower part of the long hole 123. A bottom wall of the U-shaped portion 124 is formed in an arc shape. The first inclined surface 124*a* is formed on each of two upper ends of two side walls of the U-shaped portion 124 which is located at two sides of the long hole 123. The two first inclined surfaces 124*a* obliquely extend toward a front side of the driving member 12 from top to bottom.

The engaging member 10 passes through the long hole 123 and is slidably received in the long hole 123. Two ends of the engaging member 10 are exposed out of the front side and a rear side of the driving member 12 respectively. A second contacting portion 101 is disposed near a front end of the engaging member 10 and contactably cooperates with the two first inclined surfaces 124*a*. Specifically, the engaging member 10 is a pin of a rotating structure, and the second contacting portion 101 is a flange protruding from an outer periphery of the engaging member 10. A diameter of the flange is larger than a width of the long hole 123, and therefore the flange can abut against the front side of the driving member 12. It should be noticed that the flange and the engaging member 10 can be two separate structures in this embodiment, and the flange fixedly sheathes on the engaging member 10. However, in another embodiment, the flange and the engaging member 10 can be integrally formed. Obviously, when the engaging member 10 slides downwardly within the long hole 123 and relative to the driving member 12, the two first inclined surfaces 124*a* push the engaging member 10 by the second contacting portion 101.

Furthermore, similar to the second inclined surface 110, the present invention utilizes two first inclined surfaces 124*a* for pushing the engaging member 10 stably in this embodiment. However, in another embodiment, there also can be only one first inclined surface 124*a* to drive the engaging member 10. That is, a side wall, instead of the U-shaped portion 124, protrudes from a side of the long hole 123, and one first inclined surface 124*a* is formed on an upper end of the side wall.

Besides, the second resilient member 15 is a spring which sheathes on the front end of the engaging member 10. A rear end of the second resilient member 15 abuts against the second contacting portion 101.

As shown in FIG. 2 to FIG. 5, the inner pipe 41 and the outer pipe 42 are non-circular pipes having U-shaped cross sections and internal reinforce structure. An installing seat 20 is disposed on a middle portion of the bottom pipe 2. A chamber is formed inside the installing seat 20. A shape of the chamber is corresponded to a shape of the inner pipe 41, such that the inner pipe 41 is inserted into the installing seat 20 to fix with the bottom pipe 2. The upper plug 91 is detachably connected to an upper end of the inner pipe 41. The plurality of positioning holes 410 is formed on a recess portion formed on a front side of the inner pipe 41.

A recess area 421 is formed on a front side of the outer pipe 42. The fixing hole 420 is formed on a bottom wall of the recess area 421. Two installing holes 422 are further formed on the outer pipe 42 and outside the recess area 421. The two installing holes 422 are located at two sides of the fixing hole 420 respectively. The lower plug 92 is detachably inserted into the lower end of the outer pipe 42. The lower plug 92 includes a sliding portion 921 slidably received in the recess area 421. A through hole 920 is formed on the sliding portion 921 and corresponded to the fixing hole 420. The lower plug 92 further includes two resilient plates 922 disposed on two sides of the sliding portion 921. A protrusion 923 is disposed on each of the two resilient plates 922. When the lower plug 92 is inserted into the outer pipe 42, the two protrusions 923 are pressed and the two resilient plates 922 are deformed. When the two protrusions 923 move to locations corresponded to the two installing holes 422, the two resilient plates 922 recover and the two protrusions 923 pass through the two installing holes 422, so as to install the lower plug 92 on the outer pipe 42. Furthermore, an upper end of the outer pipe 42 can be detachably connected or welded to the horizontal pipe 3.

Figure 6:
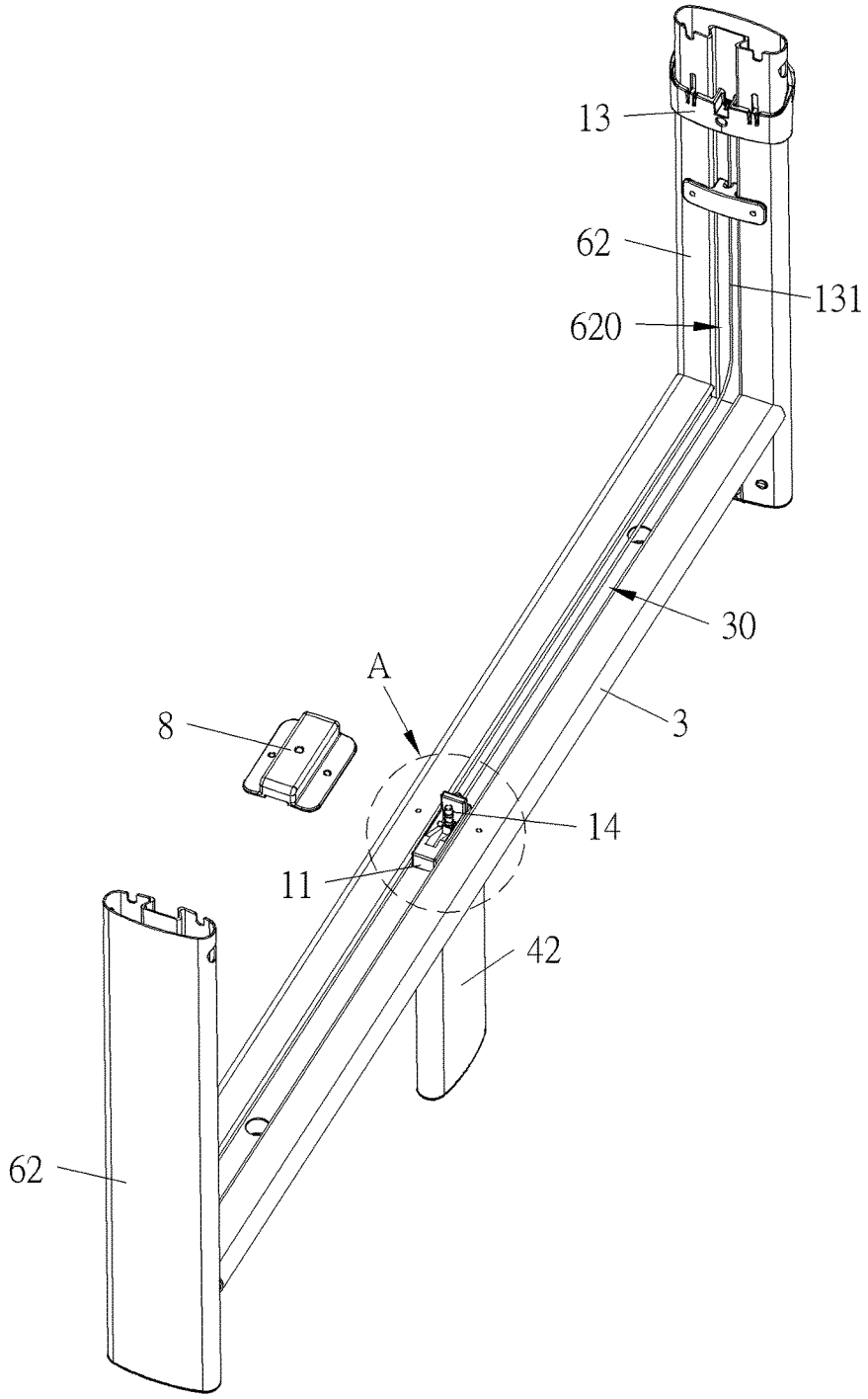
FIG. 6 is a diagram illustrating that the linking member is installed on a horizontal pipe according to the first embodiment of the present invention.
Figure 7:
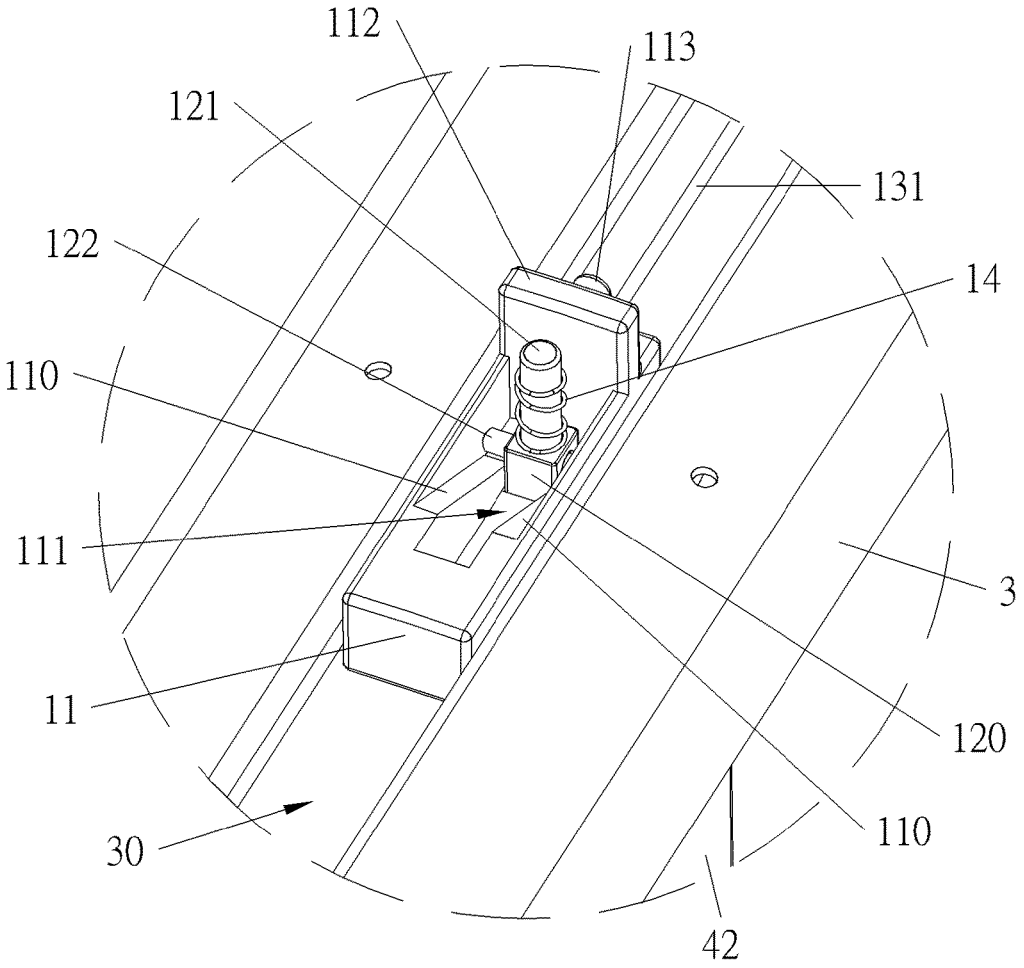
FIG. 7 is an enlarged diagram of an A portion shown in FIG. 6 according to the first embodiment of the present invention.

Detail installation process of the frame 1 and the frame height adjusting mechanism 100 is described as follows. Please refer to FIG. 6 and FIG. 7. FIG. 6 is a diagram illustrating that the linking member 11 is installed on the horizontal pipe 3 according to the first embodiment of the present invention. FIG. 7 is an enlarged diagram of an A portion shown in FIG. 6 according to the first embodiment of the present invention. The horizontal pipe 3 fixed between the two upper stands 62 is a flat pipe. A sliding slot 30 is sunk from a top surface of the horizontal pipe 3 and extends along the longitudinal direction of the horizontal pipe 3. A width of the sliding slot 30 is corresponded to a width of the linking member 11. An opening is formed on a middle portion of the sliding slot 30 for allowing the driving member 12 to pass through. The linking member 11 is slidably disposed in the sliding slot 30. The stopping portion 112 upwardly protrudes out of the sliding slot 30. The two second inclined surfaces 110 face toward one of the two upper stands 62, which is the upper one shown in FIG. 6. The operating member 13 is slidably installed on the one of the two upper stands 62. More specifically, the operating member 13 is a ring-shaped structure and sheathes on the upper stand 62 where the operating member 13 is installed. A recess slot 620 is formed on an inner side of the upper stand 62, where the operating member 13 is installed, for guiding the operating member 13. A protruding structure is disposed on an outer side of the operating member 13 for easy operation. An end of the connecting wire 131 is fixed with the operating member 13. The connecting wire 131 extends downwardly along the upper stand 62, where the operating member 13 is installed, and bends to extend along the horizontal pipe 3. The other end of the connecting wire 131 is fixed with the linking member 11. In this embodiment, the connecting wire 131 can be a steel wire. Preferably, a horizontal rod or a small roller can be disposed on a location where the upper stand 62 is connected to the horizontal pipe 3, so as to bend the connecting wire 131. Since the connecting wire 131 connects the operating member 13 and the linking member 11, when the operating member 13 is pushed upwardly, the linking member 11 is driven to slide toward the upper stand 62, where the operating member 13 is disposed. It is not required to push the linking member 11 manually and has an advantage of easy operation.

After the linking member 11 is installed, the upper end of the driving member 12 without the two first contacting portions 122 passes through the horizontal pipe 3 and the linking member 11 from bottom to top. Afterwards, the pin passes through the rectangular portion 120 to form the two first contacting portions 122. The rectangular portion 120 of the driving member 12 is slidably received in the avoiding slot 111 of the linking member 11, and the two first contacting portions 122 abut against the two lower ends of the two second inclined surfaces 110 respectively. The first resilient member 14 sheathes on the guiding column 121 on the rectangular portion 120. It should be noticed that the driving member 12 is just located within the recess area 421 of the outer pipe 42, and the U-shaped portion 124 of the driving member 12 faces forwardly at this moment.

Figure 8:
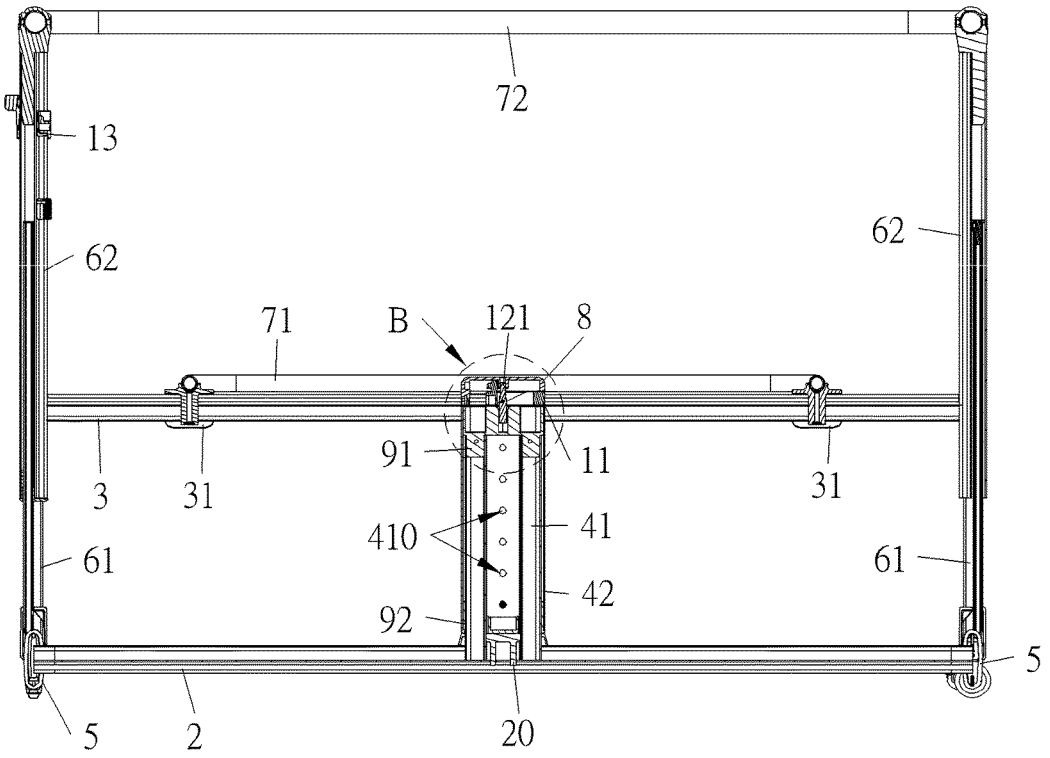
FIG. 8 is a sectional diagram of the frame along a Y-Z plane according to the first embodiment of the present invention.
Figure 9:
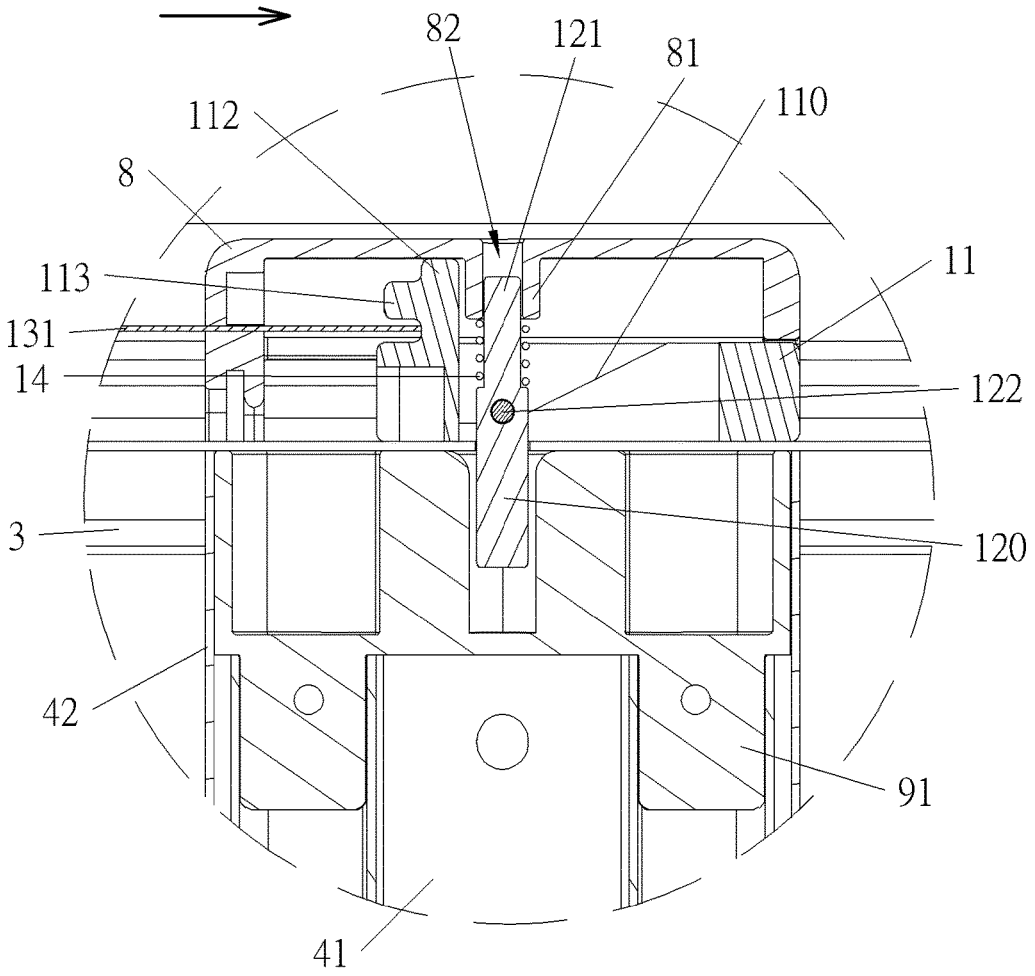
FIG. 9 is an enlarged diagram of a B portion shown in FIG. 8 according to the first embodiment of the present invention.

Please refer to FIG. 8 and FIG. 9. FIG. 8 is a sectional diagram of the frame 1 along the Y-Z plane according to the first embodiment of the present invention. FIG. 9 is an enlarged diagram of a B portion shown in FIG. 8 according to the first embodiment of the present invention. As shown in FIG. 6, FIG. 8, and FIG. 9, the cover 8 is installed on the horizontal pipe 3 by a connecting member, such as a screw, and covers the linking member 11. An abutting portion 81 downwardly protrudes from a top wall of the cover 8. The abutting portion 81 abuts against a side of the stopping portion 112 facing toward the two second inclined surfaces 110. A circular hole 82 is formed on the cover 8 and penetrates the abutting portion 81. The circular hole 82 receives the guiding column 121 and allows the guiding column 121 to pass through upwardly. The cover 8 positions the driving member 12 by the circular hole 82.

The first resilient member 14 sheathing on the guiding column 121 is pressed by the cover 8. An upper end of the first resilient member 14 resiliently abuts against a bottom surface of the abutting portion 81. A lower end of the first resilient member 14 resiliently abuts against the top surface of the rectangular portion 120. Since the cover 8 is fixed on the horizontal pipe 3, the first resilient member 14 provides a first resilient force for pushing the driving member 12 downwardly.

As shown in FIG. 4 to FIG. 6, the driving member 12 is movably disposed in the horizontal pipe 3 up and down and is slidable relative to the outer pipe 42. Specifically, a guiding slot 423 is formed on an upper end of the recess area 421 of the outer pipe 42 along the vertical direction. A rear end of the rectangular portion 120 of the driving member 12 is slidably received in the guiding slot 423. The guiding slot 423 guides the driving member 12 to slide up and down.

Figure 10:
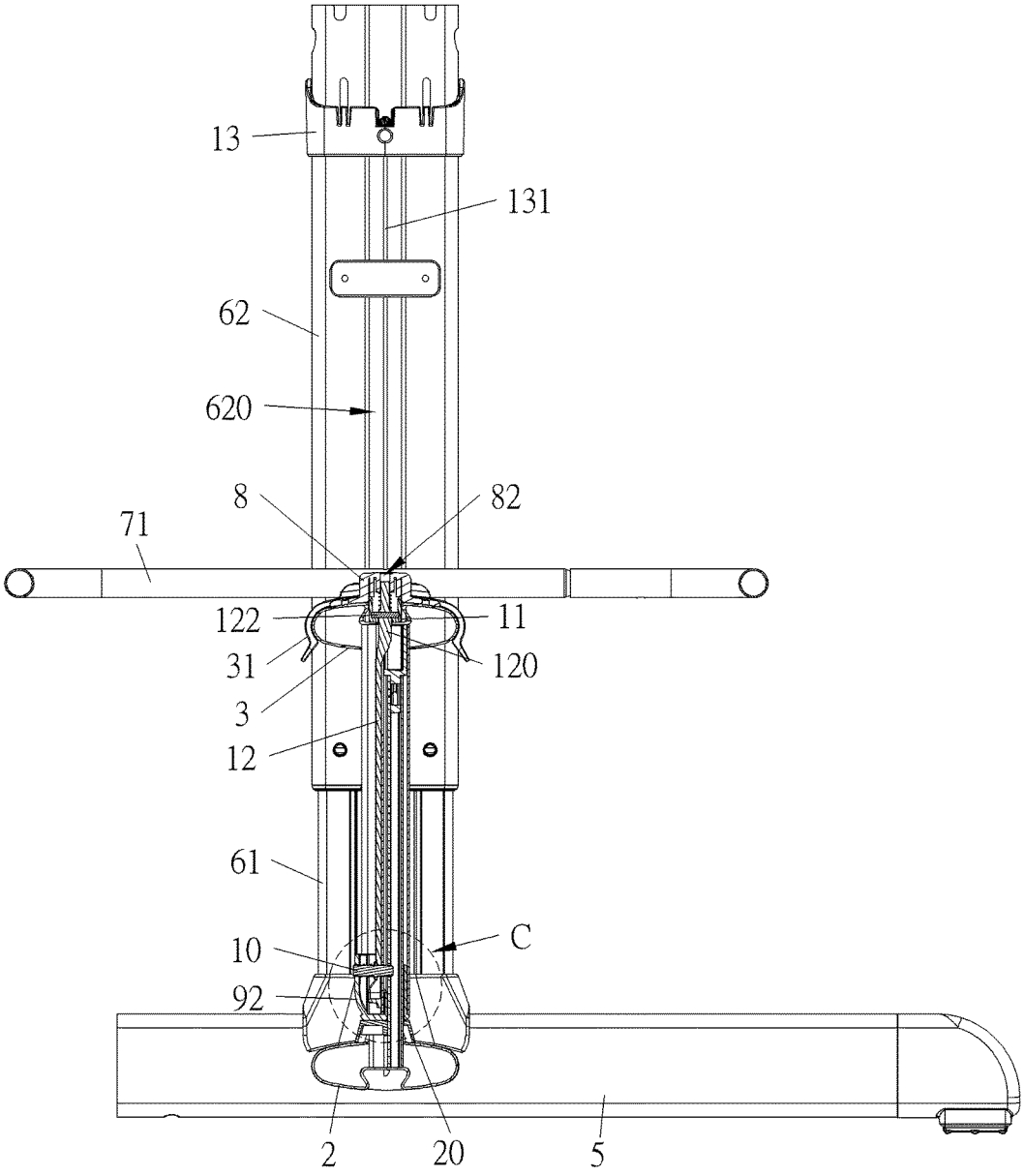
FIG. 10 is a partial sectional diagram of the frame along an X-Z plane according to the first embodiment of the present invention.
Figure 11:
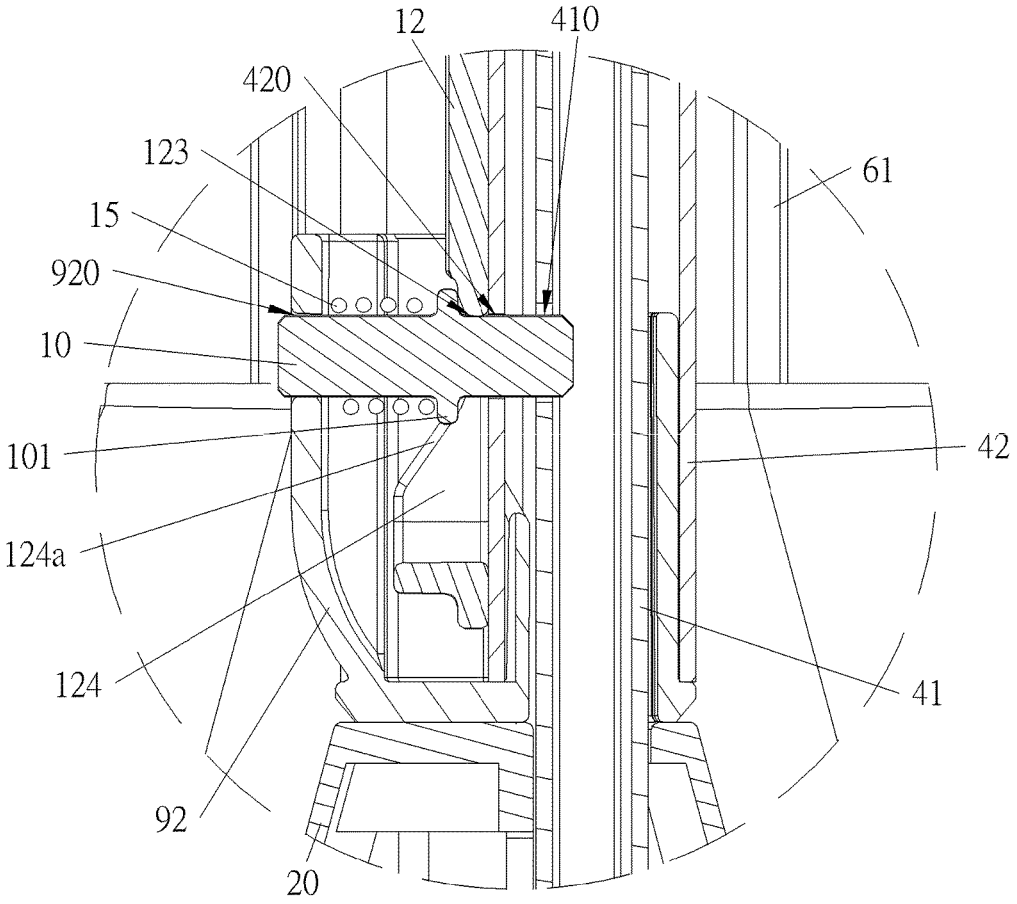
FIG. 11 is an enlarged diagram of a C portion shown in FIG. 10 according to the first embodiment of the present invention.

Please refer to FIG. 10 and FIG. 11. FIG. 10 is a partial sectional diagram of the frame 1 along an X-Z plane according to the first embodiment of the present invention. FIG. 11 is an enlarged diagram of a C portion shown in FIG. 10 according to the first embodiment of the present invention. As shown in FIG. 10 and FIG. 11, the driving member 12 is located in the recess area 421 of the outer pipe 42 after installation. The long hole 123 formed on the lower end of the driving member 12 is opposite to the fixing hole 420 formed on the outer pipe 42. The U-shaped portion 124 is formed on a side of the driving member 12 away from the rear side of the outer pipe 42. The two first inclined surfaces **124*a* obliquely extend away from the rear side of the outer pipe 42 from top to bottom. A rear end of the engaging member 10 passes through the long hole 123 and the fixing hole 420 to insert into one of the plurality of positioning holes 410 from front to back sequentially. The front end of the engaging member 10 passes through the through hole 920 formed on the lower plug 92 connected to the outer pipe 42. At this moment, the second contacting portion 101 on the engaging member 10 abuts against two front ends of the two first inclined surfaces 124*a*. The second resilient member 15 sheathing on the front end of the engaging member 10 is pressed by the lower plug 92. A front end of the second resilient member 15 resiliently abuts against the lower plug 92. A rear end of the second resilient member 15 resiliently abuts against the second contacting portion 101. Since the lower plug 92 is fixed on the outer pipe 42, the second resilient member 15 provides a second resilient force for pushing the engaging member 10 rearwardly to engage with one of the plurality of the positioning holes 410**.

As shown in FIG. 2, the supporting pipe 71 and the handle 72 of the frame 1 are formed in rectangular shapes. The supporting pipe 71 is installed on the horizontal pipe 3. The handle 72 is installed between the two upper stands 62 and located on two upper portions of the two upper stands 62. Two installing seats 31 are disposed on two sides of the horizontal pipe 3. An engaging slot is formed on each of the two installing seats 31, such that two side pipes of the supporting pipe 71 detachably engage with the two installing seats 31, so as to install the supporting pipe 71 on the horizontal pipe 3. The supporting pipe 71 and the handle 72 are for installing, supporting and mounting a carrier, such as a cradle.

In order to recover the linking member 11 which is pulled by the operating member 13, a recovering member, which is not shown in the figures, can be disposed between the linking member 11 and the cover 8. The recovering member can be specifically a spring sheathing on the protruding column 113. An end of the recovering member resiliently abuts against a side of the stopping portion 112 away from the two second inclined surfaces 110. The other end of the recovering member abuts against an inner side wall of the cover 8. Since the cover 8 is fixed on the horizontal pipe 3, the recovering member provides a recovering force for pushing the linking member 11 to slide along a direction of an arrow as shown in FIG. 9, and to abut against the abutting portion 81.

Operational principle and process of the frame height adjusting mechanism 100 and the frame 1 of the first embodiment of the present invention is described as follows.

The two first contacting portions 122 on the driving member 12 abut against the two lower ends of the two second inclined surfaces 110. The engaging member 10 passes through the long hole 123, the fixing hole 420, and one of the plurality of positioning holes 410 sequentially. The second contacting portion 101 on the driving member 12 abuts against the two upper ends of the two first inclined surfaces 124*a*. When it is desired to adjust a height of the frame 1, it is to push the operating member 13 upwardly, such that the operating member 13 slides along the upper stand 62 and drives the linking member 11 to slide relative to the horizontal pipe 3 and toward the upper stand 62 where the operating member 13 is installed. When the linking member 11 slides, the first resilient member 14 is compressed, and the driving member 12 is lifted by abutment between the two second inclined surfaces 110 and the two first contacting portions 122. When the driving member 12 is lifted, the engaging member 10 is driven by the two first inclined surfaces 124*a* and the second contacting portion 101 abutting against each other to slide forwardly, i.e., the engaging member 10 slides away from the rear side of the outer pipe 42. The engaging member 10 compresses the second resilient member 15 and disengages from the corresponded positioning hole 410. At this moment, the horizontal pipe 3 and the two upper stands 62 can be lifted or pressed, such that the outer pipe 42 slides relative to the inner pipe 41. When the height of the frame 1 is adjusted to a desired position, it is to release the operating member 13, such that the driving member 12 moves downwardly by the first resilient force of the first resilient member 14. When the driving member 12 moves downwardly, the two first inclined surfaces 124*a* do not abut against the engaging member 10 anymore, such that the engaging member 10 is driven to slide rearwardly to engage with another engaging hole 410 by the second resilient force of the second resilient member 15, so as to complete adjustment of the height of the frame 1.

Figure 12:
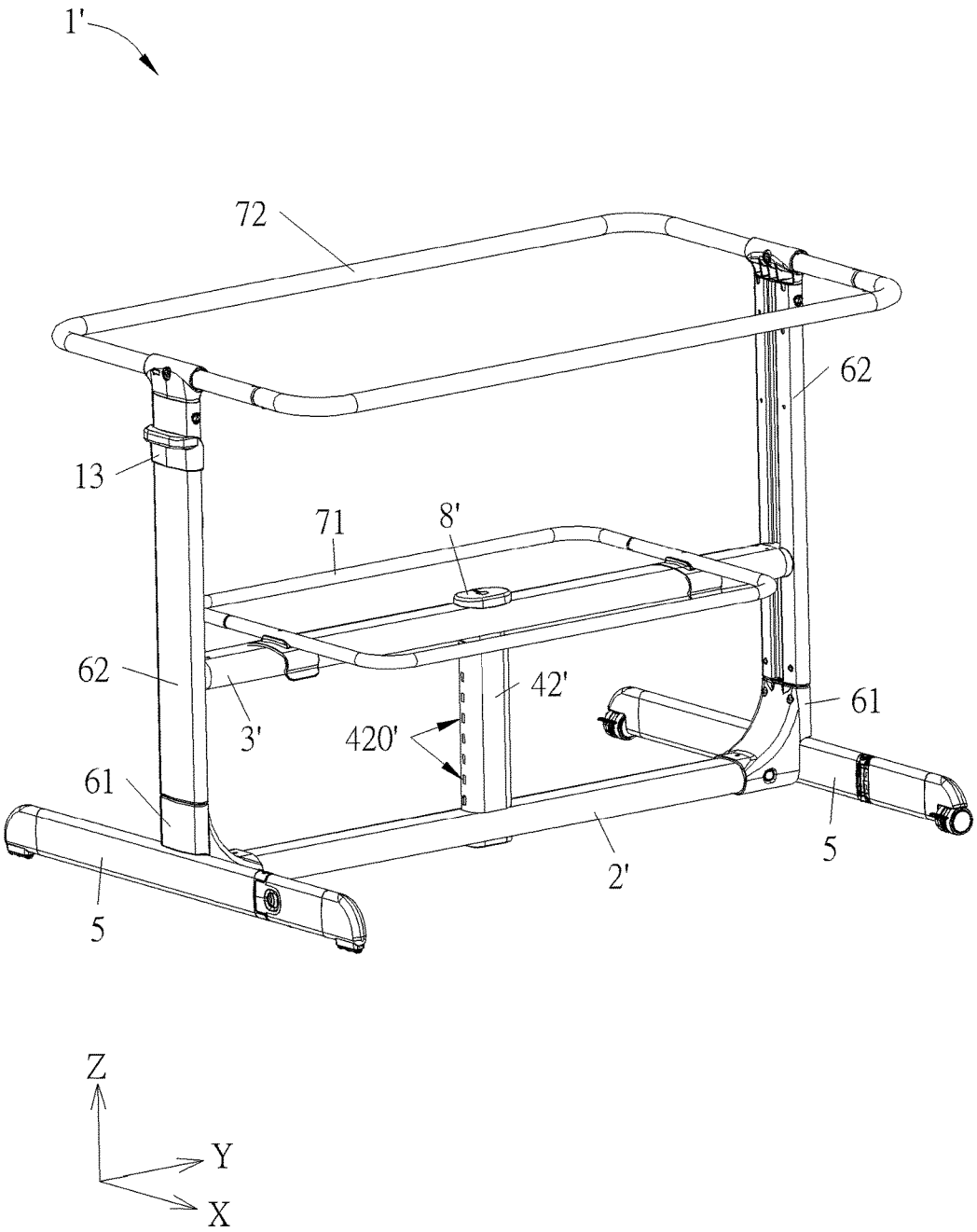
FIG. 12 is a schematic diagram of a frame according to a second embodiment of the present invention.
Figure 13:
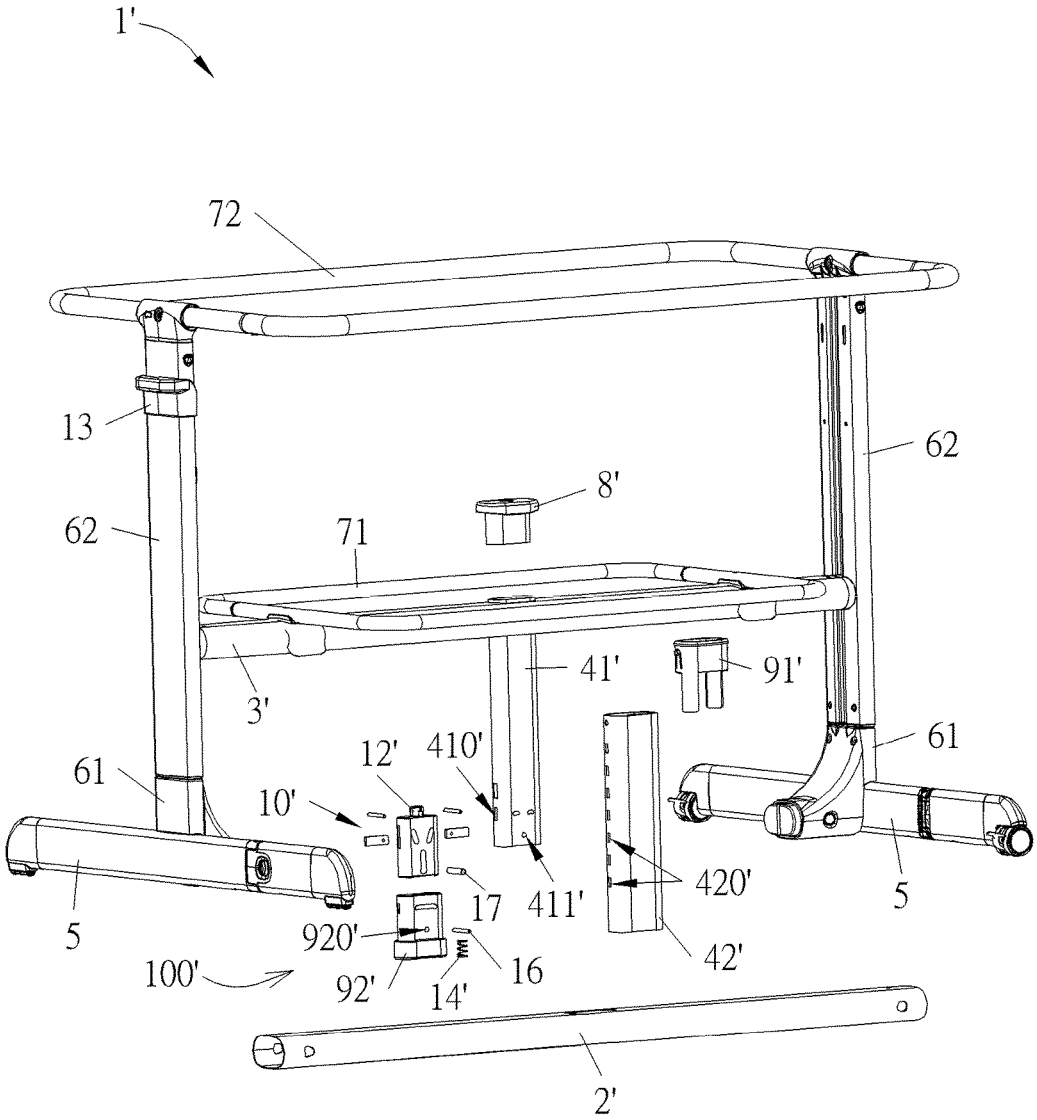
FIG. 13 is a partial exploded diagram of the frame according to the second embodiment of the present invention.

Please refer to FIG. 12 to FIG. 13. FIG. 12 is a schematic diagram of a frame 1' according to a second embodiment of the present invention. FIG. 13 is a partial exploded diagram of the frame 1' according to the second embodiment of the present invention. As shown in FIG. 12 and FIG. 13, in this embodiment, the frame 1' includes a bottom pipe 2', a horizontal pipe 3', an inner pipe 41', an outer pipe 42', the two bottom feet 5, the two lower stands 61, the two upper stands 62, the supporting pipe 71, the handle 72, a cover 8', an upper plug 91', a lower plug 92', and a frame height adjusting mechanism 100'. The frame height adjusting mechanism 100' includes two engaging members 10', a driving member 12', the operating member 13, the connecting wire, a third resilient member 14', an upper rivet 16, and a lower rivet 17. Structures of the bottom pipe 2', the two bottom feet 5, the two lower stands 61, the two upper stands 62, the supporting pipe 71, and the handle 72 of the second embodiment are similar to the ones of the first embodiment. Furthermore, structural connections between the aforementioned parts of the second embodiment are similar to the ones of the first embodiment.

The horizontal pipe 3' is fixed between the two upper stands 62. Since the frame height adjusting mechanism 100' does not include a linking member, a sliding slot is not required to be formed on a top surface of the horizontal pipe 3'. Instead, an opening is formed on a middle portion of the horizontal pipe 3' and penetrates the horizontal pipe 3' for allowing the connecting wire to pass through.

The inner pipe 41' and the outer pipe 42' are hollow pipes having substantially elliptical cross sections. The inner pipe 41' is fixed on a lower end of the horizontal pipe 3'. The outer pipe 42' is fixed on the bottom pipe 2' and slidably sheathes on the inner pipe 41'. The cover 8' is disposed above the horizontal pipe 3' and inserted into the inner pipe 41' downwardly to seal an opening formed on an upper end of the inner pipe 41'. A gap is formed on the cover 8' for allowing the connecting wire to pass through. The upper plug 91' is inserted into an upper end of the outer pipe 42' and sheathes on the inner pipe 41'. Structural connection between the upper plug 91' and the outer pipe 42' of the second embodiment is similar to structural connection between the outer pipe 42 and the lower plug 92 of the first embodiment.

Figure 14:
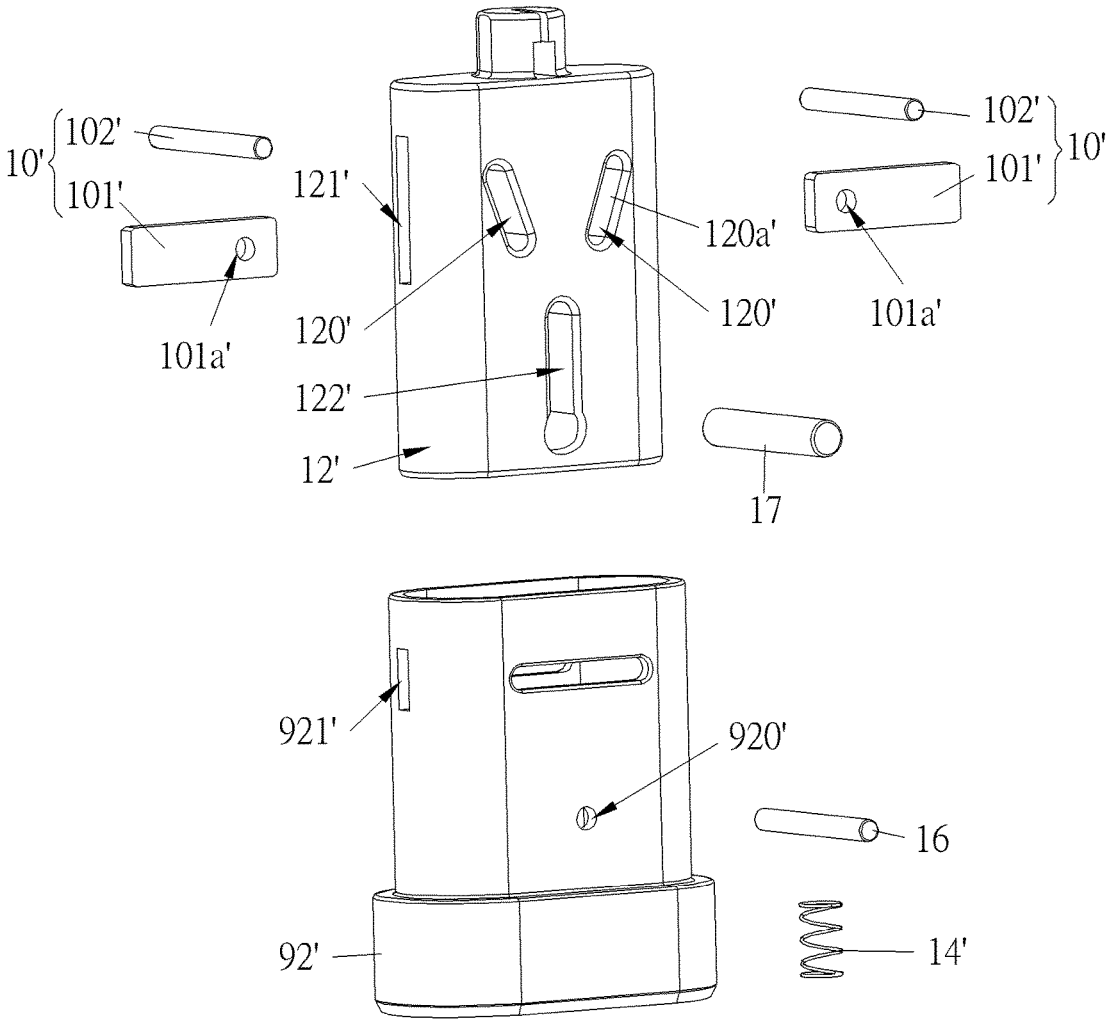
FIG. 14 is a schematic diagram of a driving member, two engaging members, a lower plug, an upper rivet, a lower rivet, and a third resilient member of the frame according to the second embodiment of the present invention.

Please refer to FIG. 14. FIG. 14 is a schematic diagram of the driving member 12', the two engaging members 10', the lower plug 92', the upper rivet 16, the lower rivet 17, and the third resilient member 14' of the frame 1' according to the second embodiment of the present invention. As shown in FIG. 13 and FIG. 14, a positioning through hole 411' is formed on each of a front wall and a rear wall of a lower end of the inner pipe 41'. A chamber with an upward opening is formed on the lower plug 92' for receiving the driving member 12'. A circular hole 920' is formed on the lower plug 92' and corresponded to the positioning through hole 411'. The lower plug 92' is inserted into a lower part of the inner pipe 41'. The upper rivet 16 passes through the positioning through hole 411' and the circular hole 920', so as to fix the lower plug 92' on the inner pipe 41'.

Two fixing holes 410' are formed on two sides of the lower end of the inner pipe 41' respectively. Two rows of the positioning holes 420' are formed on two sides of the outer pipe 42' along the vertical direction. The two rows of the positioning holes 420' are corresponded to the two fixing holes 410'.

Figure 15:
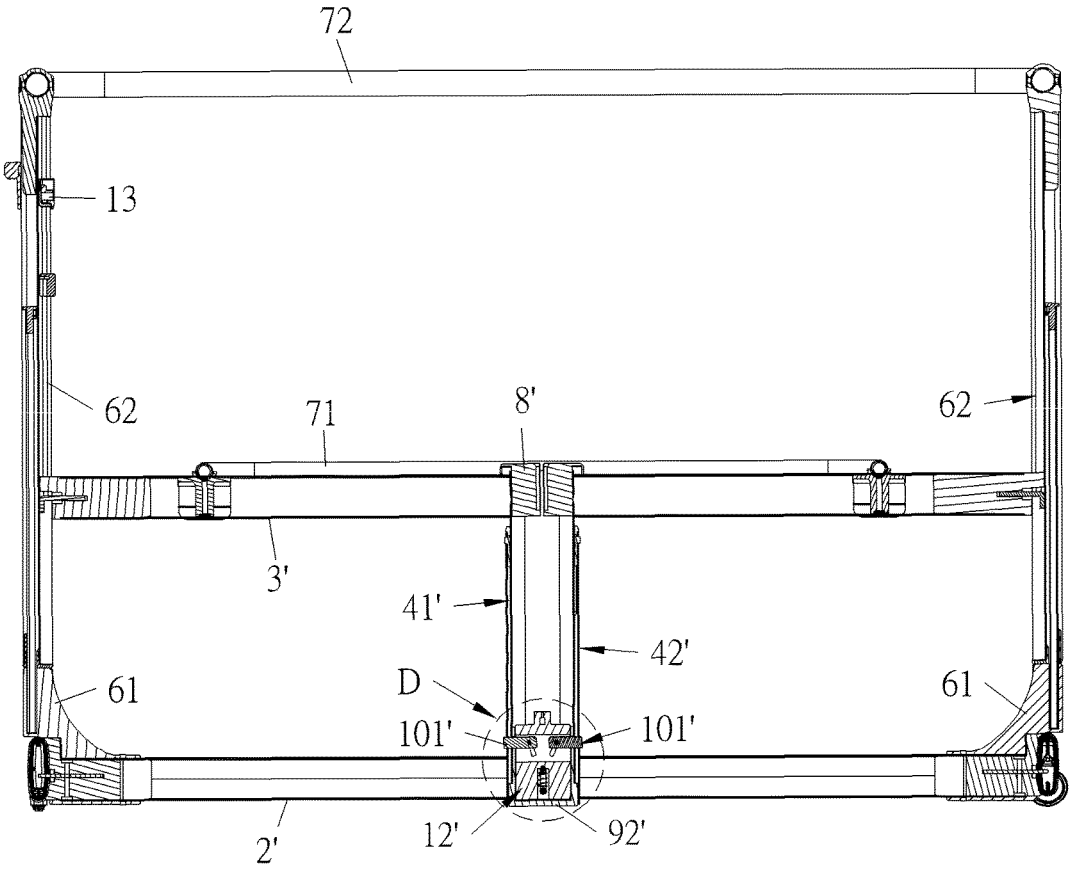
FIG. 15 is a sectional diagram of the frame along a Y-Z plane according to the second embodiment of the present invention.
Figure 16:
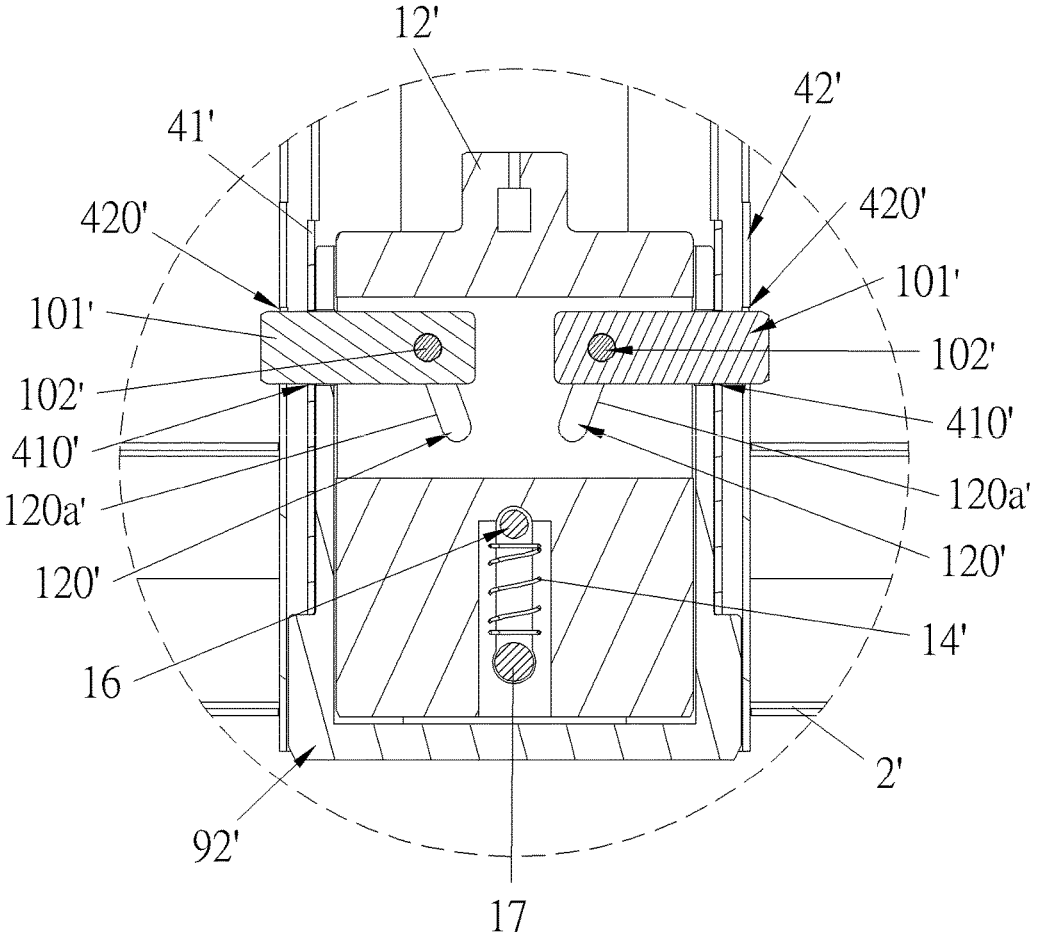
FIG. 16 is an enlarged diagram of a D portion shown in FIG. 15 according to the second embodiment of the present invention.

Please refer to FIG. 15 and FIG. 16. FIG. 15 is a sectional diagram of the frame 1' along a Y-Z plane according to the second embodiment of the present invention. FIG. 16 is an enlarged diagram of a D portion shown in FIG. 15 according to the second embodiment of the present invention. As shown in FIG. 14 to FIG. 16, two sliding slots 120' are formed on an upper end of the driving member 12'. The two sliding slots 120' extend obliquely and penetrate the driving member 12'. A distance between two upper ends of the two sliding slots 120' is larger than a distance between two lower ends of the two sliding slot 120'. A first inclined surface 120*a'* is defined by an outer side wall of each of the two sliding slots 120'. A hollow chamber is formed in the driving member 12' and communicates with the two sliding slots 120'. Two first openings 121' are formed on two sides of the driving member 12' and communicate with the hollow chamber. A long slot 122' is formed on the driving member 12' along the vertical direction and located under a midpoint between the two sliding slots 120'. A lower end of the long slot 122' is enlarged to receive the lower rivet 17. A diameter of the lower rivet 17 is larger than a width of an upper end of the long slot 122', such that the lower rivet 17 is restrained from sliding relative to the long slot 122'. The driving member 12' is slidably disposed in the inner pipe 41'. Precisely, the driving member 12' is slidably received in the lower plug 92'. Two second openings 921' are formed on the lower plug 92' and corresponded to the two first openings 121'. The two first openings 121', the two second openings 921' and the two fixing holes 410' are adjacent sequentially and communicate with one another. An inner bottom surface of the lower plug 92' is located under the driving member 12', such that the lower plug 92' can push the driving member 12' upwardly.

Each of the two engaging member 10' includes a locking member 101' and a sliding pin 102' protruding from a side of the locking member 101'. Specifically, a through hole 101*a*' is formed on the locking member 101'. The sliding pin 102' passes through the through hole 101*a*' and protrudes from two sides of the locking member 101'. However, in another embodiment, the sliding pin 102' and the locking member 101' can be integrally formed.

The two locking members 101' are slidably received in the driving member 12'. Two ends of the two locking members 101' protrude from the two sides of the driving member 12' through the two first openings 121' and pass through the two second openings 921' and the two fixing holes 410'. The two sliding pins 102' of the two engaging members 10' are slidably disposed in the two sliding slots 120'. When the two ends of the two locking members 101' pass through the two fixing holes 410' to engage with the corresponded positioning holes 420' on the outer pipe 42', the two sliding pins 102' are located at the two upper ends of the two sliding slots 120'. A distance between each of the two lower ends of the two sliding slots 120' and the corresponded fixing hole 410' is larger than a distance between each of the two upper ends of the two sliding slots 120' and the corresponded fixing hole 410'. The two first inclined surfaces 120*a*' are located near the two fixing holes 410' corresponded to the two engaging members 10'. Therefore, when the driving member 12' slides upwardly, the locking member 101' is driven to slide inwardly to disengage from the corresponded positioning hole 420'.

Furthermore, the upper rivet 16 passes through the driving member 12' and is slidably disposed in the long slot 122', the upper rivet 16 is located above the lower rivet 17, and the third resilient member 14' can be a spring disposed between the upper rivet 16 and the lower rivet 17. Since the upper rivet 16 and the lower rivet 17 are fixed on the inner pipe 41' and the driving member 12' respectively, the third resilient member 14' provides a third resilient force for recovering the driving member 12' to slide downwardly relative to the inner pipe 41'.

As shown in FIG. 12, the operating member 13 is slidably installed on one of the two upper stands 62. An end of the connecting wire is fixed with the operating member 13. The connecting wire extends downwardly along the upper stand 62 where the operating member 13 is installed, and the connecting wire bends to extend along the horizontal pipe 3'. Finally, the other end of the connecting wire stretches into the inner pipe 41' and is fixed with the upper end of the driving member 12'. Similar to the first embodiment, the connecting wire of the second embodiment can be a steel wire.

Operational principle and process of the frame height adjusting mechanism 100' and the frame 1' of the second embodiment of the present invention are described as follows. As shown in FIG. 12 and FIG. 16, the operating member 13 is pulled upwardly to slide along the upper stand 62 and drives the driving member 12' to slide upwardly in the inner pipe 41', i.e., the lower plug 92', by the connecting wire. When the driving member 12' slides upwardly, the two first inclined surfaces 120*a*' of the two sliding slots 120' push the two sliding pins 102' inwardly. The two sliding pins 102' drive the two locking members 101' fixed with the two sliding pins 102' to slide relative to the driving member 12' inwardly and disengage from the corresponded positioning holes 420'. At this moment, the frame 1' is unlock, and the horizontal pipe 3' and the two upper stands 62 can be lifted or pressed to adjust a height of the frame 1'. When the horizontal pipe 3' is lifted, the lower plug 92' disposed on the lower end of the inner pipe 41' drives the driving member 12' to move upwardly. When the frame 1' is adjusted to a desired position, the operating member 13 is released, such that the driving member 12' is driven to slide downwardly by the third resilient force of the third resilient member 14'. The other two inclined surfaces of the two sliding slots 120' opposite to the two first inclined surfaces 120*a*' push the two sliding pins 102' outwardly, such that the two locking members 101' slide out of the driving member 12' and pass through the two fixing holes 410' to engage with another corresponded positioning holes 420', which firmly positions the frame 1' at the desired position.

In contrast to the prior art, the present invention utilizes the driving member for driving the at least one engaging member to engage with or disengage from one of the plurality of positioning holes. When the driving member drives the at least one engaging member to disengage from the corresponded positioning hole by sliding upwardly, the outer pipe can slide relative to the inner pipe vertically. After the outer pipe is adjusted to a desired height relative to the inner pipe, the driving member recovers downwardly and drives the at least one engaging member to engage with another positioning hole, so as to lock the outer pipe and the inner pipe. In a practical application, one of the inner pipe and the outer pipe is fixed on one of a lower part and an upper part of the frame, and the other one of the inner pipe and the outer pipe is fixed on the other one of a lower part and an upper part of the frame. Accordingly, an overall height of the frame can be adjusted by sliding movement of the outer pipe relative to the inner pipe. Therefore, a height of a cradle supported by the frame can be adjusted according to actual requirement.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A frame height adjusting mechanism adapted for a frame, the frame comprising a horizontal pipe, a cover installed on the horizontal pipe, an inner pipe and an outer pipe sheathing on the inner pipe and fixed on a lower end of the horizontal pipe, a sliding slot being sunk from a top surface of the horizontal pipe, a fixing hole being formed on a front side of a lower end of the outer pipe, a plurality of positioning holes being formed on a side of the inner pipe adjacent to the fixing hole along a vertical direction, and the frame height adjusting mechanism comprising:

a driving member slidably disposed on the outer pipe, the driving member comprising at least one first inclined surface, an upper end of the driving member passing through the horizontal pipe upwardly and being movable relative to the horizontal pipe along the vertical direction;

at least one engaging member slidably disposed on the driving member and passing through the fixing hole to insert into one of the plurality of positioning holes, the at least one first inclined surface pushing the at least one engaging member to disengage from the corresponded positioning hole when the driving member slides upwardly, the at least one engaging member and the at least one first inclined surface being disposed on a lower end of the driving member;

a linking member slidably disposed on the horizontal pipe along a longitudinal direction of the horizontal pipe, the linking member comprising at least one second inclined surface driven to push the driving member by the linking member, the linking member being slidably received in the sliding slot and covered by the cover;

a stopping portion upwardly protruding from an end of the linking member near a side of a lower end of the at least one second inclined surface; and an abutting portion downwardly protruding from the cover and abutting against a side of the stopping portion toward the at least one second inclined surface.

2. The frame height adjusting mechanism of claim 1, wherein an extending direction of the at least one second inclined surface and a sliding direction of the linking member are located in a same plane, and the frame height adjusting mechanism further comprises at least one first contacting portion disposed on the upper end of the driving member and abutting against the lower end of the at least one second inclined surface.

3. The frame height adjusting mechanism of claim 2, wherein the driving member further comprises a rectangular portion, and the at least one first contacting portion is a column protruding from a side of the rectangular portion.

4. The frame height adjusting mechanism of claim 3, wherein an avoiding slot is formed on the linking member and extends along the sliding direction of the linking member, the driving member passes through the linking member, the rectangular portion is slidably received in the avoiding slot, the linking member comprises two second inclined surfaces disposed on two sides of the avoiding slot, and the frame height adjusting mechanism comprises two first contacting portions respectively protruding from two sides of the rectangular portion.

5. The frame height adjusting mechanism of claim 3, wherein a guiding slot is formed on the outer pipe along the vertical direction, and the rectangular portion is slidably received in the guiding slot.

6. The frame height adjusting mechanism of claim 1, further comprising a first resilient member disposed between the cover and the linking member, and the first resilient member providing a first resilient force for pushing the driving member downwardly.

7. The frame height adjusting mechanism of claim 1, wherein a circular hole is formed on the cover for allowing the driving member to pass through upwardly, and the circular hole penetrates the abutting portion.

8. The frame height adjusting mechanism of claim 1, wherein the at least one first inclined surface obliquely extends away from a rear side of the outer pipe from top to bottom, the at least one engaging member comprises a second contacting portion, and the second contacting portion abuts against an upper end of the at least one first inclined surface when the at least one engaging member is inserted into one of the plurality of positioning holes.

9. The frame height adjusting mechanism of claim 8, wherein a recess area is formed on a front side of the outer pipe, the fixing hole is formed on a bottom wall of the recess area, the driving member is located in the recess area, a long hole is formed on the lower end of the driving member and corresponded to the fixing hole, the long hole extends along the vertical direction, the at least one first inclined surface located at an outer periphery of the long hole protrudes from a side of the driving member away from the rear side of the outer pipe, the at least one engaging member is a pin of a rotating structure, and the second contacting portion protrudes from an outer periphery of the at least one engaging member.

10. The frame height adjusting mechanism of claim 9, wherein a U-shaped portion protrudes from the side of the driving member away from the rear side of the outer pipe and encloses a lower portion of the long hole, and the at least one first inclined surface is formed on an upper end of each of two side walls of the U-shaped portion.

11. The frame height adjusting mechanism of claim 9, wherein the frame further comprises a lower plug detachably inserted into the lower end of the outer pipe, the lower plug comprises a sliding portion slidably received in the recess portion, and a through hole is formed on the sliding portion and corresponded to the fixing hole.

12. The frame height adjusting mechanism of claim 11, further comprising a second resilient member disposed between the lower plug and the at least one engaging member, the second resilient member providing a second resilient force for inserting the at least one engaging member into one of the plurality of positioning holes.

13. The frame height adjusting mechanism of claim 1, further comprising an operating member and a connecting wire, the operating member being slidably disposed on the frame, an end of the connecting wire being fixed on the operating member, and the other end of the connecting wire extending along the horizontal pipe and being fixed on the linking member.

14. A frame comprising:

two bottom feet disposed oppositely;

two lower stands vertically fixed on the two bottom feet respectively;

two upper stands sheathing on the two lower stands respectively;

a bottom pipe disposed between the two bottom feet;

a horizontal pipe fixed between the two upper stands, a sliding slot being sunk from a top surface of the horizontal pipe;

a cover installed on the horizontal pipe;

an inner pipe fixed on the bottom pipe;

an outer pipe slidably sheathing on the inner pipe and fixed on a lower end of the horizontal pipe, a fixing hole being formed on a front side of a lower end of the outer pipe, a plurality of positioning holes being formed on a side of the inner pipe adjacent to the fixing hole along a vertical direction; and a frame height adjusting mechanism comprising:

a driving member slidably disposed on the outer pipe, the driving member comprising at least one first inclined surface, an upper end of the driving member passing through the horizontal pipe upwardly and being movable relative to the horizontal pipe along the vertical direction;

at least one engaging member slidably disposed on the driving member and passing through the fixing hole to insert into one of the plurality of positioning holes, the at least one first inclined surface pushing the at least one engaging member to disengage from the corresponded positioning hole when the driving member slides upwardly, the at least one engaging member and the at least one first inclined surface being disposed on a lower end of the driving member;

a linking member slidably disposed on the horizontal pipe along a longitudinal direction of the horizontal pipe, the linking member comprising at least one second inclined surface driven to push the driving member by the linking member, the linking member being slidably received in the sliding slot and covered by the cover;

a stopping portion upwardly protruding from an end of the linking member near a side of a lower end of the at least one second inclined surface; and an abutting portion downwardly protruding from the cover and abutting against a side of the stopping portion toward the at least one second inclined surface.

15. The frame of claim 14, further comprising a supporting pipe installed on the horizontal pipe.

16. The frame of claim 15, wherein the supporting pipe is rectangular, the frame further comprises two installing seats disposed on two ends of the horizontal pipe, an engaging slot is formed on each of the two installing seats, and two side pipes of the supporting pipe detachably respectively engage with the two engaging slots.

17. The frame of claim 14, further comprising a handle fixed between the two upper stands and disposed on tops of the two upper stands.

* * * * *